US008424644B2

(12) United States Patent
D'Abbraccio

(10) Patent No.: US 8,424,644 B2
(45) Date of Patent: Apr. 23, 2013

(54) BRACKET FOR CONNECTING SAWHORSES

(76) Inventor: Philip J. D'Abbraccio, Farmingdale, NY (US)

( * ) Notice: Subject to any disclaimer, the term of this patent is extended or adjusted under 35 U.S.C. 154(b) by 149 days.

(21) Appl. No.: 12/931,723

(22) Filed: Feb. 9, 2011

(65) Prior Publication Data

US 2012/0199419 A1 Aug. 9, 2012

(51) Int. Cl.
*E04G 1/04* (2006.01)

(52) U.S. Cl.
USPC ..... 182/181.1

(58) Field of Classification Search ..... 182/181.1, 182/226; 256/64
See application file for complete search history.

(56) References Cited

U.S. PATENT DOCUMENTS

| | | | | | |
|---|---|---|---|---|---|
| 1,838,151 | A | * | 12/1931 | Penote | 256/64 |
| 1,961,760 | A | * | 6/1934 | Hamren | 182/226 |
| 2,647,803 | A | | 8/1953 | Bohm | |
| 2,976,020 | A | * | 3/1961 | Harris | 256/64 |
| 3,289,789 | A | | 12/1966 | Larson | |
| 3,713,512 | A | | 1/1973 | Reece | |
| 3,965,540 | A | * | 6/1976 | Moore | 248/251 |
| 4,017,943 | A | | 4/1977 | Moore | |
| 4,104,980 | A | | 8/1978 | Toomey | |
| 4,348,133 | A | | 9/1982 | Trent et al. | |
| 4,544,303 | A | | 10/1985 | Glasmire | |
| 4,979,725 | A | | 12/1990 | Hutchings, II et al. | |
| 5,230,495 | A | | 7/1993 | Brackus | 248/300 |
| D356,488 | S | | 3/1995 | Gehiere | D8/354 |
| 5,484,037 | A | | 1/1996 | Neumarkel | |
| D398,514 | S | | 9/1998 | Anderson | D8/349 |
| 6,113,053 | A | | 9/2000 | Kumagai et al. | 248/499 |
| 6,131,354 | A | | 10/2000 | Thompson | 52/511 |
| 6,213,047 | B1 | | 4/2001 | Means et al. | |
| D457,052 | S | | 5/2002 | Snyder | D8/349 |
| 6,601,809 | B1 | | 8/2003 | Gebrara | |
| 6,886,799 | B2 | | 5/2005 | Yamanashi | 248/610 |
| 6,913,236 | B2 | | 7/2005 | Weyandt | 248/300 |
| D523,735 | S | | 6/2006 | Craine | D8/354 |
| D550,604 | S | | 9/2007 | Walton et al. | D12/317 |
| D576,026 | S | | 9/2008 | Mazzocco | D8/382 |
| D580,260 | S | | 11/2008 | Collins et al. | D8/382 |
| D591,586 | S | | 5/2009 | Dagg | D8/382 |
| D599,193 | S | | 9/2009 | Meyer et al. | D8/354 |
| D605,496 | S | | 12/2009 | Scheuermann et al. | D8/349 |
| D619,447 | S | | 7/2010 | Liu | D8/354 |
| D622,579 | S | | 8/2010 | Heindl | D8/382 |
| D626,663 | S | | 11/2010 | Stephens | D25/124 |
| D627,207 | S | | 11/2010 | Chen | D8/354 |
| D627,489 | S | | 11/2010 | Stephens | D25/124 |
| D630,344 | S | | 1/2011 | Stephens | D25/124 |
| D631,324 | S | | 1/2011 | Azuma et al. | D8/354 |
| 2005/0230188 | A1 | | 10/2005 | Berg | |
| 2007/0289813 | A1 | * | 12/2007 | Bothwell et al. | 182/222 |

* cited by examiner

*Primary Examiner* — Alvin Chin Shue
(74) *Attorney, Agent, or Firm* — Richard L. Miller

(57) ABSTRACT

A bracket for replaceably connecting an end of a crossbar of a conventional PVC sawhorse to a crossbar of another conventional PVC sawhorse to thereby replaceably connect the conventional PVC sawhorse to the another conventional PVC sawhorse to form a barrier. The bracket includes a first portion and a second portion. The first portion and the second portion are normally coplanar. The first portion is replaceably received by the end of the crossbar of the conventional PVC sawhorse. The second portion replaceably receives the crossbar of the another conventional PVC sawhorse to thereby replaceably connect the conventional PVC sawhorse to the another conventional PVC sawhorse to form the barrier.

6 Claims, 7 Drawing Sheets

Fig. 10
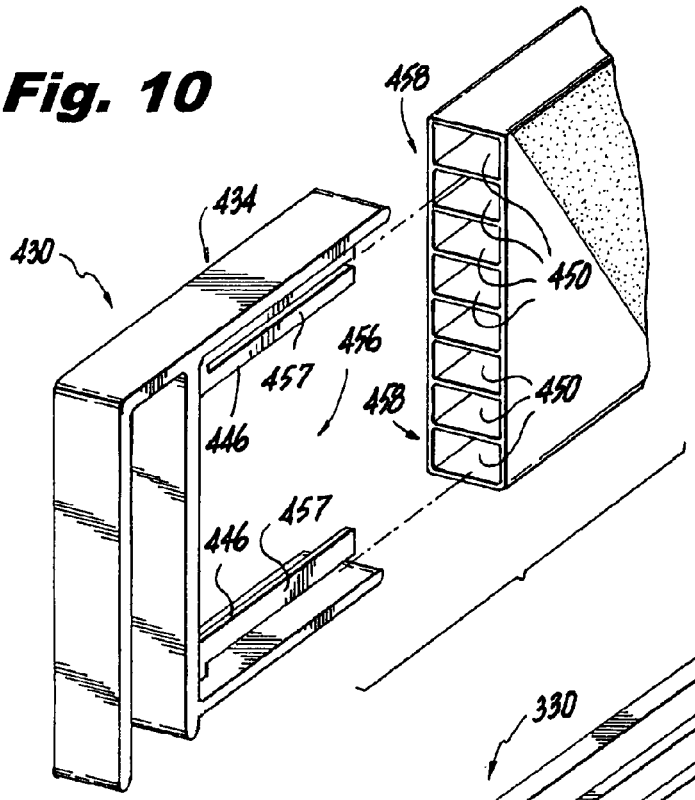
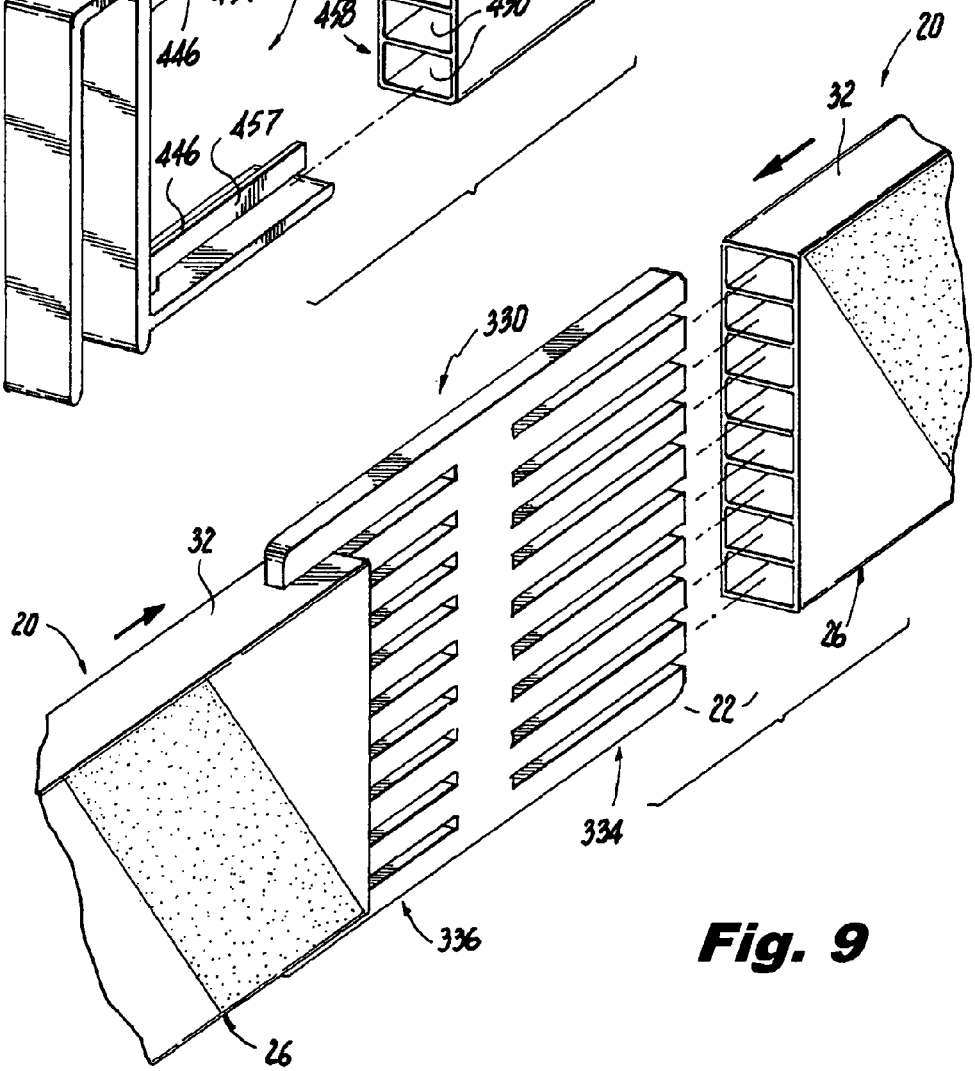
Fig. 9

BRACKET FOR CONNECTING SAWHORSES

BACKGROUND OF THE INVENTION

A. Field of the Invention.

The embodiments of the present invention relate to a sawhorse-related bracket, and more particularly, the embodiments of the present invention relate to a bracket for replaceably connecting an end of a crossbar of a conventional PVC sawhorse to a crossbar of another conventional PVC sawhorse to thereby replaceably connect the conventional PVC sawhorse to the another conventional PVC sawhorse to form a barrier.

B. Description of the Prior Art.

As shown in FIG. 1, which is a diagrammatic perspective view of a prior art pair of conventional PVC sawhorses orthogonally positioned to form a barrier, a prior art pair of conventional PVC sawhorses 20 are orthogonally positioned to form a barrier 22 by merely being positioned octagonally to each other with no connection therebetween. Each conventional PVC sawhorse 20 includes a pair of A-frames 24 and a pair of crossbars 26.

Numerous innovations for barriers have been provided in the prior art, which will be described below in chronological order to show advancement in the art, and which are incorporated herein by reference thereto. Even though these innovations may be suitable for the specific individual purposes to which they address, however, they differ from the present invention in that they do not teach a bracket for replaceably connecting an end of a crossbar of a conventional PVC sawhorse to a crossbar of another conventional PVC sawhorse to thereby replaceably connect the conventional PVC sawhorse to the another conventional PVC sawhorse to form a barrier.

(1) U.S. Pat. No. 2,647,803 to Bohm.

U.S. Pat. No. 2,647,803 issued to Bohm on Aug. 4, 1953 in U.S. class 304 and subclass 5 teaches a sawhorse connector bracken, including a pair of spaced opposed side walls and a pair of spaced opposed end walls. The walls have a permanent rigid interconnection. The end walls are downwardly divergent, and the side walls have their central portions similarly offset toward each other, and each forming at its offsets a pair of downwardly divergent shoulders respectively substantially parallel to the respective end walls, whereby the shoulders are correlated with the end walls and adjoining portions of the side walls to form a pair of spaced downwardly divergent sockets for receiving a pair of sawhorse legs. The offset central portions have similar notches extending downwardly from their upper edges, between the shoulders of each such portion, to jointly receive the cross bar of a sawhorse. A pair of tongues are struck out of the notches in the offset portions and project oppositely outward from the portions, and have their major portions within recesses exteriorly formed in the side walls by their offset portions.

(2) U.S. Pat. No. 3,289,789 to Larson.

U.S. Pat. No. 3,289,789 issued to Larson on Dec. 6, 1966 in U.S. class 182 and subclass 226 teaches a collapsible sawhorse bracket assembly for interconnecting a crosspiece and a pair of legs in converging relationship with each other and to the crosspiece. The assembly includes a pair of separate and independent brackets. Each bracket includes a main wall adapted to be fixedly secured to one edge of an associated leg at one end thereof, and a side flange formed integral with the wall and disposed substantially perpendicular thereto and along the outer face of the associated leg at the one end thereof. The main wall and the side flange extend beyond the adjacent end of the associated leg, and the main wall has a cutout therein on the edge opposite the side flange for receiving a supporting crosspiece therein. An abutment flange is integral with the main wall, disposed substantially perpendicular thereto, and extends in the same direction as the side flange and is adapted to lie against the upper end of the associated leg. A guide range integral with the main wall and disposed substantially perpendicular thereto and extending therefrom in the same direction as the side flange and placed therefrom a distance to receive the associated leg therebetween. A plurality of openings in the main wall in the area thereof defined by the side flange and the abutment flange and the guide flange for receiving fasteners there-through to secure the bracket to the associated leg. A crosspiece flange integral with one edge of the main wall defines the cutout and is disposed substantially perpendicular thereto and extends therefrom in a direction opposite to the side flange and is adapted to lie along the side of an associated crosspiece. The crosspiece flange has an opening therein for receiving a fastener there-through to secure the bracket to the associated crosspiece. The brackets are overlapped and have aligned pivot apertures therethrough. A pivot pin is disposed in the aligned pivot apertures and pivotally interconnects the brackets to provide an axis for pivoting the legs with respect thereto, between a folded position wherein the outer ends thereof are adjacent to each other and an operative position wherein the outer ends thereof are spaced apart. Each of the brackets has an L-shaped slot in the main wall thereof including first and second arms. The first arm of each of the L-shaped slots is arranged with the longitudinal axis thereof in alignment with the first arm of the other L-shaped slot when the legs are in the operative position thereof. The second arm of each of the L-shaped slots is arranged at the end of the associated first arm thereof disposed toward the pivot pin and extends therefrom outwardly toward the associated leg. A lock pin is disposed in the L-shaped slots and is movable therealong in the aligned portions thereof, between a locking position and a non-locking position, as the legs move between the operative and the folded positions thereof. The lock pin in the locking position is disposed at the ends of the aligned first arms disposed away from the pivot pin, with the legs in the operative position thereof. The lock pin in the nonlocking position is disposed in aligned portions of the second arms, with the legs in the folded position thereof.

(3) U.S. Pat. No. 3,713,512 to Reece.

U.S. Pat. No. 3,713,512 issued to Reece on Jan. 30, 1973 in U.S. class 182 and subclass 226 teaches a bracket for connecting together two legs and an upper crosspiece of a sawhorse or similar structure. The bracket includes two elements into which the upper ends of the sawhorse legs are insertable. The bracket has upper portions adapted upon relative pivotal movement of the two elements to grip the crosspiece of the sawhorse, with a toggle linkage being actuable by downward movement of a manually operated handle to swing the two elements to their gripping positions, and to simultaneously actuate gripping teeth into holding engagement with the legs.

(4) U.S. Pat. No. 4,104,980 to Toomey.

U.S. Pat. No. 4,104,980 issued to Toomey on Aug. 8, 1978 in U.S. class 116 and subclass 63P teaches a collapsible road barrier that includes at least one horizontal reflective member that is attached to the upper portion of four supporting legs. The four supporting legs are positioned in pairs, with the upper portion thereof hinged together and the lower portion thereof spaced from each other so as to provide support for the horizontal reflective member. The collapsible road barrier also includes a universally collapsible bunk positioned adjacent the lower ends of the supporting legs. The universally collapsible bunk is generally rectangular in shape, with each of the four corners of the bunk being attached to one of the supporting legs to provide a surface upon which material, such as ballast, may be positioned. The collapsible road barrier is readily folded to provide for convenient storage.

(5) U.S. Pat. No. 4,348,133 to Trent et al.

U.S. Pat. No. 4,348,133 issued to Trent et al. on Sep. 7, 1982 in U.S. Class 404 and subclass 6 teaches a highway median barrier construction formed as integral U-shaped shell sections of polymer concrete that are placed end-to-end at the construction site and are then filled with hydraulic concrete or other ballast through filling holes that are then capped with polymer concrete.

(6) U.S. Pat. No. 4,544,303 to Glasmire.

U.S. Pat. No. 4,544,303 issued to Glasmire on Oct. 1, 1985 in U.S. Class 404 and subclass 6 teaches a protective traffic barrier for diverting motor vehicle traffic away from an object or roadway. A base with wedge-shaped projections extending vertically from the base impedes the movement of a motor vehicle across the barrier. The shape of the base is designed to fulfill a particular function including an opening to allow the barrier to fit over an object to be protected. A resilient, preferably plastic, cover encapsulating the base protects people or animals from contact injury with the wedge-shaped projections, while allowing the projections to penetrate a vehicle tire. The cover is coated with various materials to enhance visibility of the barrier by motor vehicle operators.

(7) U.S. Pat. No. 4,979,725 to Hutchings, II et al.

U.S. Pat. No. 4,979,725 issued to Hutchings, II et al. on Dec. 25, 1990 in U.S. class 256 and subclass 64 teaches a triangular frame assembly for supporting a safety barrier of boards above the edge of a roof during construction. The triangular assembly employs pivotal connections between a base and a lower stanchion member, between the base and a diagonal brace, and between the diagonal brace and an upper stanchion member telescopically connected to the lower stanchion member. The angle between the stanchion and the base are adjusted to accommodate a wide range of roof pitches by varying the telescopic engagement of the upper and lower stanchion members. The range of roof pitch angles for which the frame assembly is used is increased by making the upper stanchion member invertable, adapting both ends thereof to alternatively telescopically engage the lower stanchion member, and by providing for an off-center brace connection to the upper stanchion member. A variation provides for a rigid triangular frame secured below the eave of a roof for supporting a stanchion extending above the eave.

(8) U.S. Pat. No. 5,484,037 to Neumarkel.

U.S. Pat. No. 5,484,037 issued to Neumarkel on Jan. 16, 1996 in U.S. class 182 and subclass 185.1 teaches a connector for use in assembling a sawhorse. The sawhorse has an elongate cross member mid four elongate leg members joined together using two connectors. Each connector is manufactured from a tubular center sleeve having a bottom wall and defining an interior passage having a longitudinal axis. The interior passage receives an end of the cross member. The connector also includes first and second tubular leg sockets. Each socket defines an interior passage having a longitudinal axis. The first and second sockets are secured in opposing angular disposition to the center sleeve, so that the longitudinal axes of the first and second sockets are disposed radially relative to the longitudinal axis of the center sleeve. Each of the first and second sockets receives an end of one of first and second leg members. The received ends of the first and second leg members bear against the bottom wall of the center sleeve.

(9) U.S. Pat. No. 6,213,047 to Means et al.

U.S. Pat. No. 6,213,047 issued to Means et al. on Apr. 10, 2001 in U.S. class 116 and subclass 28R teaches a telescopic device mounted onto the side of an emergency vehicle, which has reflectors, lights, or a caution sign mounted on its rear facing surface, so that when it is in its extended position the reflectors, lights, or caution sign are visible to the oncoming traffic and thereby act as a safety warning. The device has a base for being mounted directly onto the side of the emergency or maintenance vehicle. The base contains a hinge about which the telescopic member rotates. Each telescopic section of the telescopic member has apparatus for stopping each other section including overlapping lips that allow the sections to be extended.

It is apparent that numerous innovations for barriers have been provided in the prior art that are adapted to be used. Furthermore, even though these innovations may be suitable for the specific individual purposes to which they address, however, they would not be suitable for the purposes of the embodiments of the present invention as heretofore described, namely, a bracket for replaceably connecting an end of a crossbar of a conventional PVC sawhorse to a crossbar of another conventional PVC sawhorse to thereby replaceably connect the conventional PVC sawhorse to the another conventional PVC sawhorse to form a barrier.

SUMMARY OF THE INVENTION

Thus, an object of the embodiments of the present invention is to provide a bracket for replaceably connecting an end of a crossbar of a conventional PVC sawhorse to a crossbar of another conventional PVC sawhorse to thereby replaceably connect the conventional PVC sawhorse to the another conventional PVC sawhorse to form a barrier, which avoids the disadvantages of the prior art.

Briefly stated, another object of the embodiments of the present invention is to provide a bracket for replaceably connecting an end of a crossbar of a conventional PVC sawhorse to a crossbar of another conventional PVC sawhorse to thereby replaceably connect the conventional PVC sawhorse to the another conventional PVC sawhorse to form a barrier. The bracket includes a first portion and a second portion. The first portion and the second portion are normally coplanar. The first portion is replaceably received by the end of the crossbar of the conventional PVC sawhorse. The second portion replaceably receives the crossbar of the another conventional PVC sawhorse to thereby replaceably connect the conventional PVC sawhorse to the another conventional PVC sawhorse to form the barrier.

The novel features considered characteristic of the embodiments of the present invention are set forth in the appended claims. The embodiments of the present invention themselves, however, both as to their construction and to their method of operation together with additional objects and advantages thereof will be best understood from the following description of the specific embodiments when read and understood in connection with the accompanying figures of the drawing.

BRIEF DESCRIPTION OF THE FIGURES OF THE DRAWING

The figures of the drawing are briefly described as follows:

FIG. 9 is an exploded diagrammatic perspective view of a third embodiment of the bracket of the present invention connecting the one kind of crossbar of the conventional PVC sawhorse coaxially to the one kind of crossbar of the another conventional PVC sawhorse; and FIG. 10 is an enlarged exploded perspective view of a fourth embodiment of the bracket of the present invention connecting to the one kind of crossbar of the conventional PVC sawhorse.

LIST OF REFERENCE NUMERALS UTILIZED IN THE FIGURES OF THE DRAWING

Figure 1:
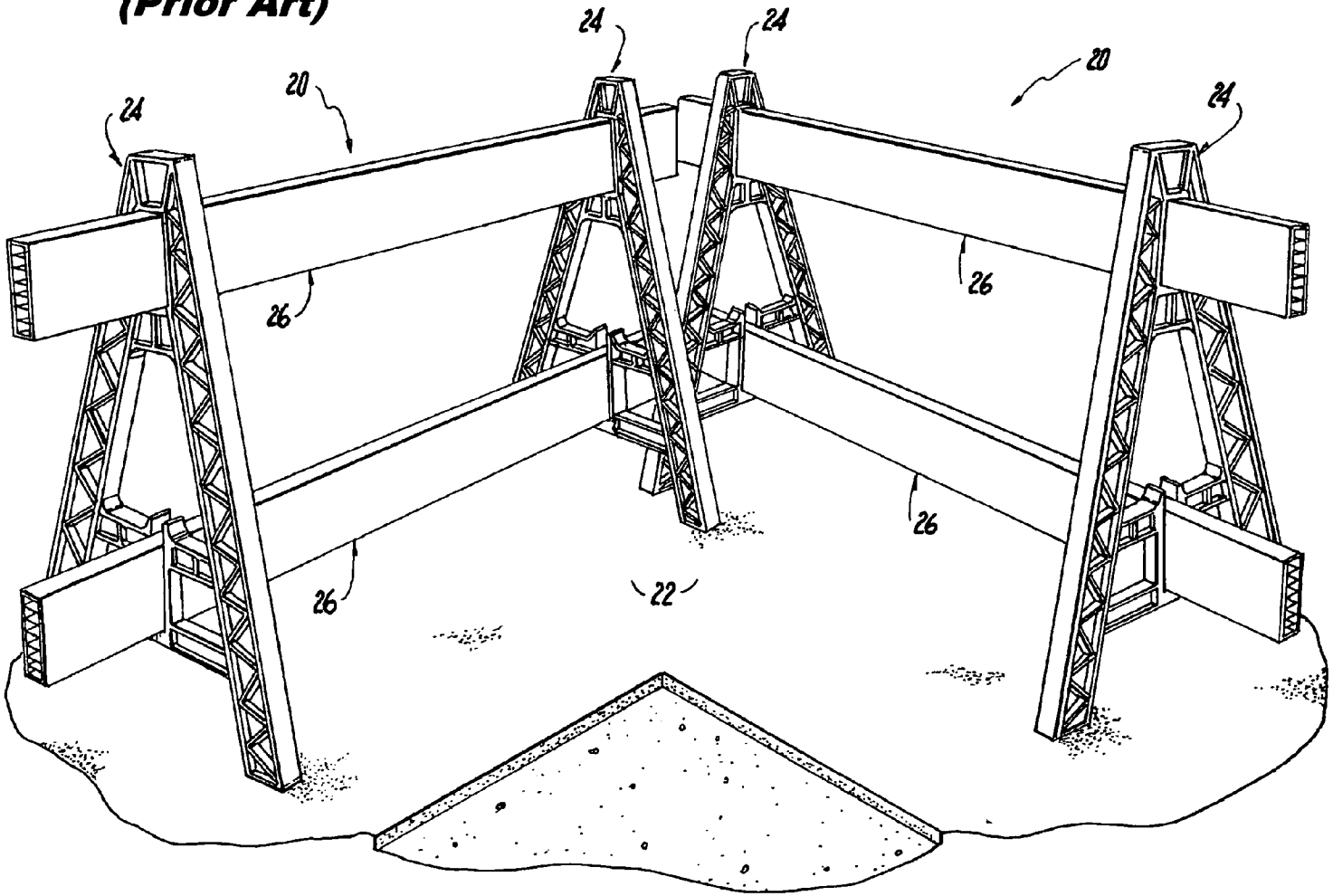
Fig. 1 (Prior Art)
FIG. 1 is a diagrammatic perspective view of a prior art pair of conventional PVC sawhorses orthogonally positioned to form a barrier.

Prior Art.

20 prior art pair of conventional PVC sawhorses

22 barrier

24 pair of A-frames of each conventional PVC sawhorse of prior art pair of conventional PVC sawhorses 20

26 pair of crossbars of each conventional PVC sawhorse of prior art pair of conventional PVC sawhorses 20

A. General.

30 bracket of embodiment of present invention for replaceably connecting end 32 of crossbar 26 of conventional PVC sawhorse 20 to crossbar 26 of another conventional PVC sawhorse 20 to thereby replaceably connect conventional PVC sawhorse 20 to another conventional PVC sawhorse 20 to form barrier 22

32 end of crossbar 26 of conventional PVC sawhorse 20

B. Overall Configuration of Bracket 30.

34 first portion for being replaceably received by end 32 of crossbar 26 of conventional PVC sawhorse 20

36 second portion for replaceably receiving crossbar 26 of another conventional PVC sawhorse 20

C. Specific Configuration of First Embodiment of Bracket 130.

130 bracket

134 first portion

136 second portion

138 top edge of first portion 134 and second portion 136

140 bottom edge of first portion 134 and second portion 136

142 inner edge of first portion 134 and second portion 136

144 outer edge of first portion 134 and second portion 136

(1) First Portion 134.

146 plurality of fingers of first portion 134 for extending into end 32 of crossbar 26 of conventional PVC sawhorse 20

148 spaces of first portion 134

150 axial cells in crossbar 26 of conventional PVC sawhorse 20

151 web of crossbar 26 of conventional PVC sawhorse 20

152 pair of channeled flanges of crossbar 26 of conventional PVC sawhorse 20

(2) Second Portion 136.

154 throughslot of second portion 136 for receiving crossbar 32 of another conventional PVC sawhorse 20 by sliding down over crossbar 32 of another conventional PVC sawhorse 20

D. Specific Configuration of Second Embodiment of Bracket 230.

230 bracket for replaceably connecting end 32 of crossbar 26 of conventional PVC sawhorse 20 to crossbar 26 of another conventional PVC sawhorse 20 to thereby replaceably connect conventional PVC sawhorse 20 at a desired angle to another conventional PVC sawhorse 20 to form barrier 22

234 first portion

236 second portion

E. Specific Configuration of Third Embodiment of Bracket 330.

330 bracket for connecting end 32 of crossbar 26 of conventional PVC sawhorse 20 coaxially to end 32 of crossbar 26 of another conventional PVC sawhorse 20 to form barrier 22

334 first portion

336 second portion

F. Specific Configuration of Fourth Embodiment of Bracket 430.

430 bracket

434 first portion

446 plurality of fingers of first portion 434

456 central portion of first portion 434

457 upper and lower fingers of plurality of fingers 446 of first portion 434 for insertion into only upper and lower portions 458 of axial cells 450 of crossbar 26 of conventional PVC sawhorse 20

458 only upper and lower portions of axial cells 450 of crossbar 26 of conventional PVC sawhorse 20

DETAILED DESCRIPTION OF THE PREFERRED EMBODIMENTS

A. General.

Figure 2:
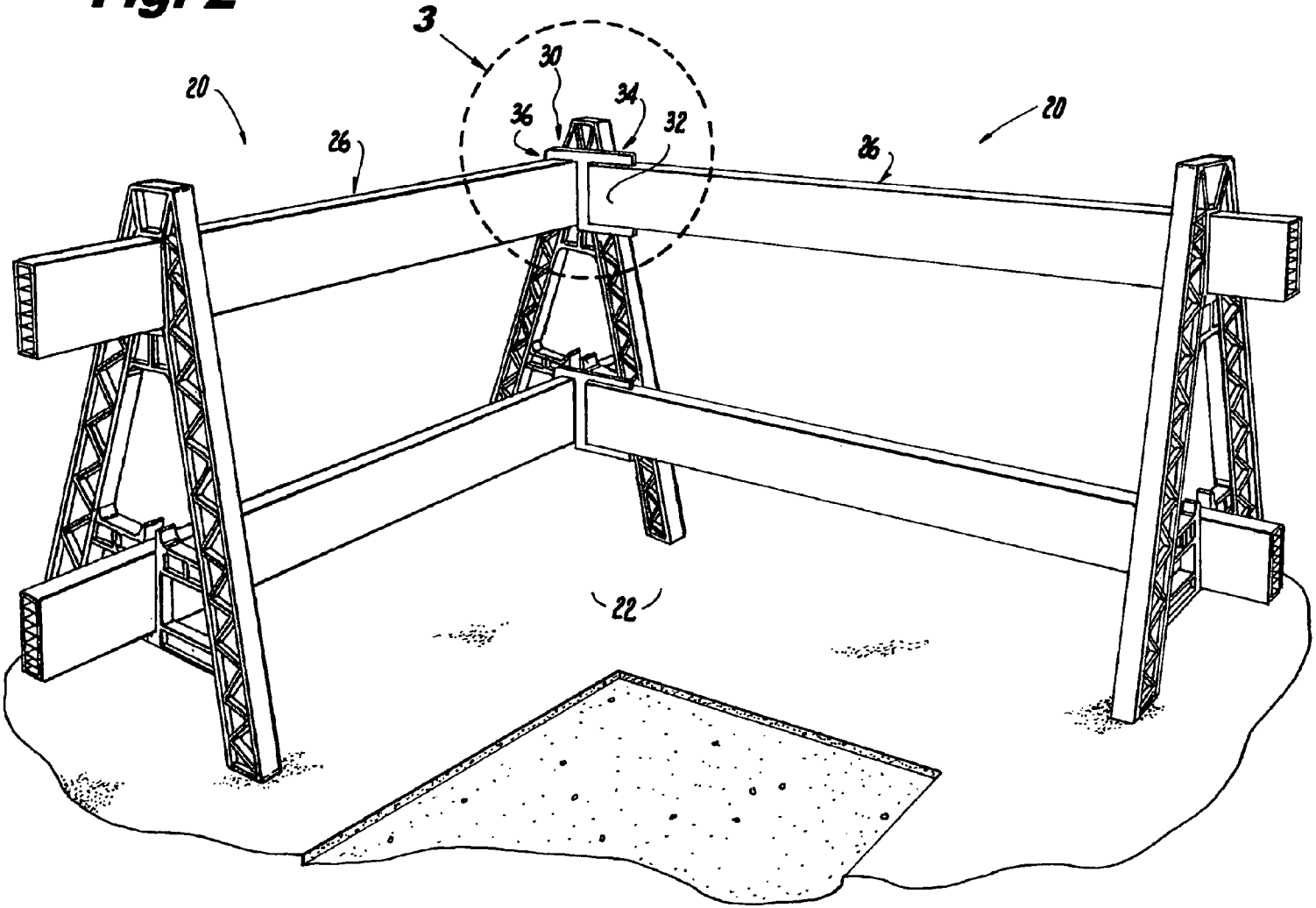
FIG. 2 is a diagrammatic perspective view of the bracket of the embodiments of the present invention replaceably connecting an end of a crossbar of a conventional PVC sawhorse to a crossbar of another conventional PVC sawhorse to thereby replaceably connect the conventional PVC sawhorse orthogonally to the another conventional PVC sawhorse to form a barrier.

Referring now to FIG. 2, which is a diagrammatic perspective view of the bracket of the embodiments of the present invention replaceably connecting an end of a crossbar of a conventional PVC sawhorse to a crossbar of another conventional PVC sawhorse to thereby replaceably connect the conventional PVC sawhorse orthogonally to the another conventional PVC sawhorse to form a barrier, the bracket of an embodiment of the present invention is shown generally at 30 for replaceably connecting an end 32 of a crossbar 26 of a conventional PVC sawhorse 20 to a crossbar 26 of another conventional PVC sawhorse 20 to thereby replaceably connect the conventional PVC sawhorse 20 to the another conventional PVC sawhorse 20 to form a barrier 22.

B. Overall Configuration Bracket 30.

Figure 3:
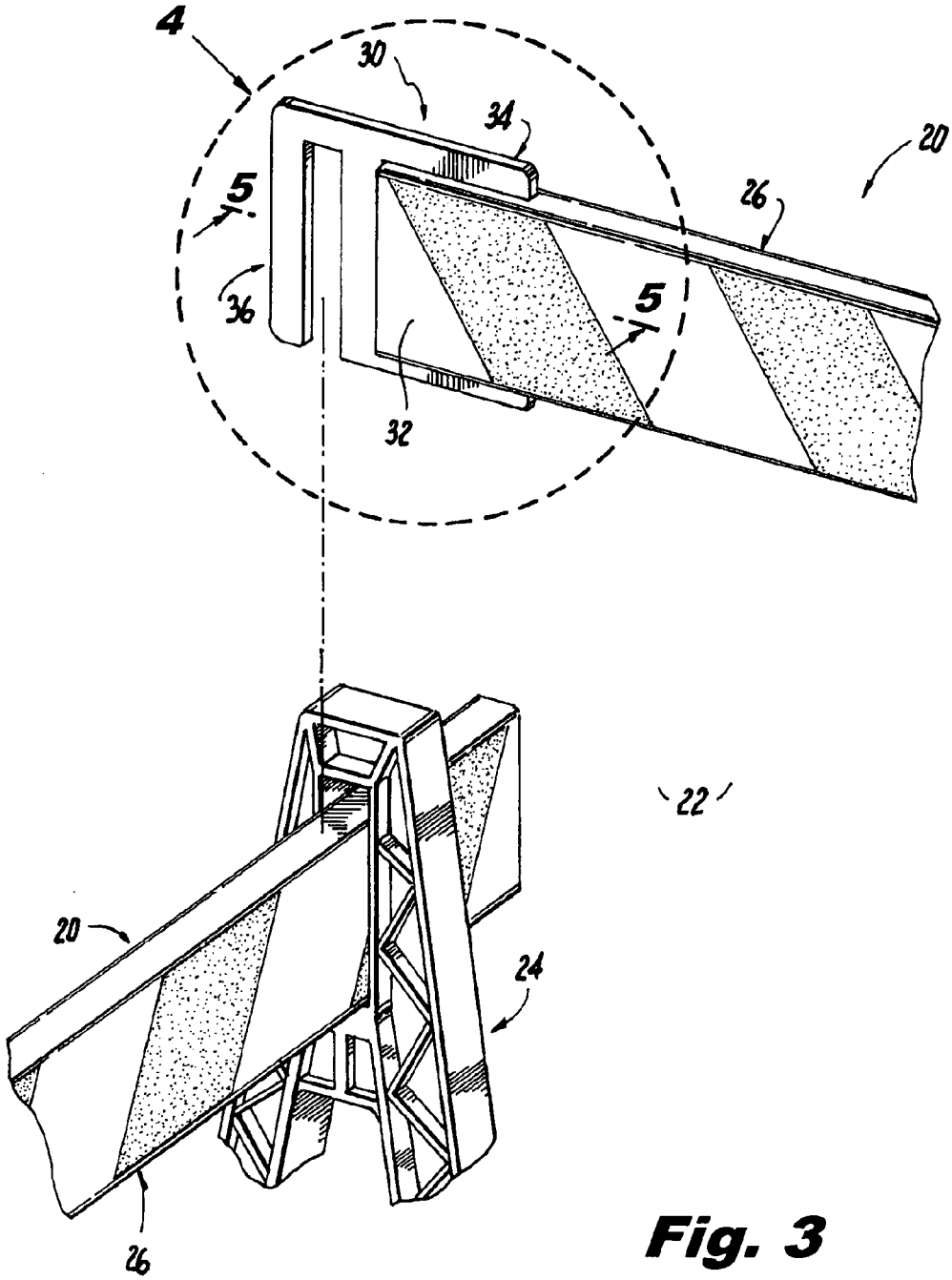
FIG. 3 is an enlarged exploded perspective view of the area generally enclosed by the dotted curve identified by ARROW 3 in FIG. 2 of a first embodiment of the bracket of the present invention connecting to one kind of crossbar of a conventional PVC sawhorse.

The overall configuration of the bracket 30 can best be seen in FIGS. 2 and 3, which are, respectively, again a diagrammatic perspective view of the bracket of the embodiments of the present invention replaceably connecting an end of a crossbar of a conventional PVC sawhorse to a crossbar of another conventional PVC sawhorse to thereby replaceably connect the conventional PVC sawhorse orthogonally to the another conventional PVC sawhorse to form a barrier, and an enlarged exploded perspective view of the area generally enclosed by the dotted curve identified by ARROW 3 in FIG. 2 of a first embodiment of the bracket of the present invention connecting to one kind of crossbar of a conventional PVC sawhorse, and as such, will be discussed with reference thereto.

The bracket 30 comprises a first portion 34 and a second portion 36. The first portion 34 and the second portion 36 are normally coplanar. The first portion 34 is for being replaceably received by the end 32 of the crossbar 26 of the conventional PVC sawhorse 20. The second portion 36 is for replaceably receiving the crossbar 26 of the another conventional PVC sawhorse 20 to thereby replaceably connect the conventional PVC sawhorse 20 to the another conventional PVC sawhorse 20 to form the barrier 22.

C. Specific Configuration of a First Embodiment of the Bracket 130.

Figure 4:
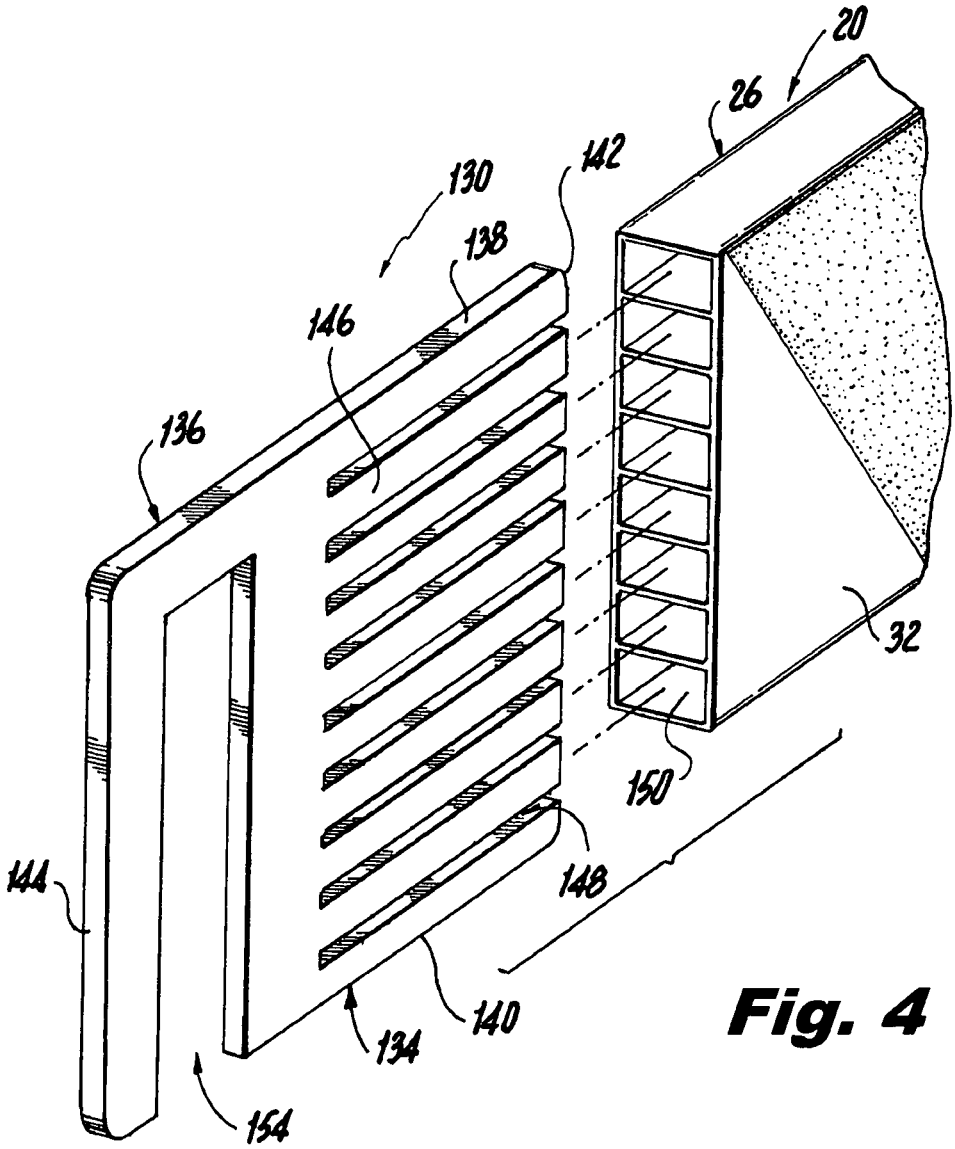
FIG. 4 is an enlarged exploded perspective view of the area generally enclosed by the dotted curve identified by ARROW 4 in FIG. 3.
Figure 5:
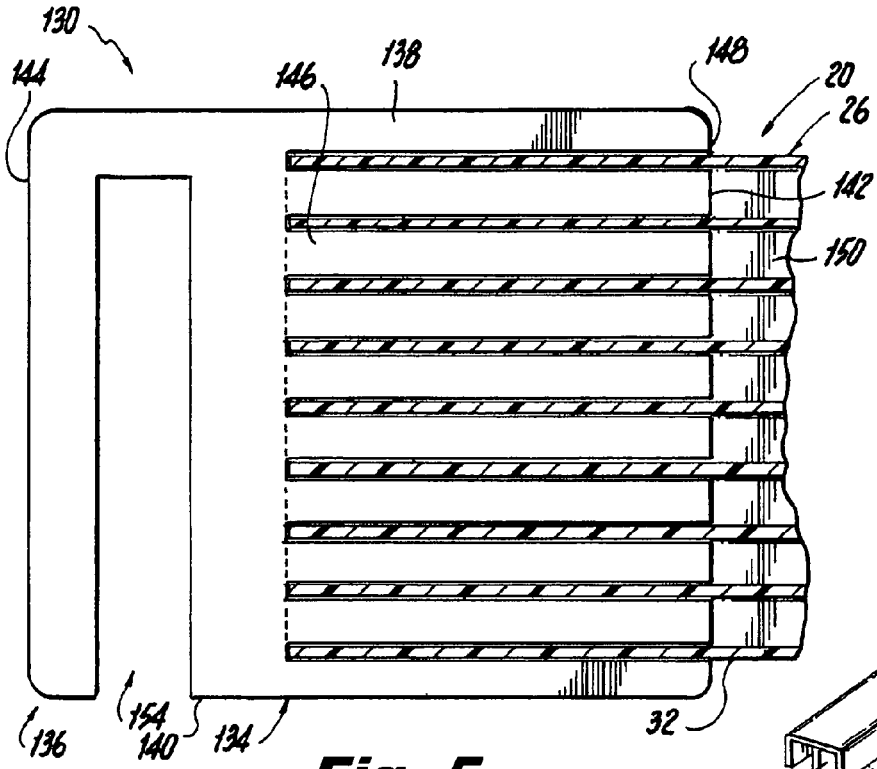
FIG. 5 is an enlarged diagrammatic cross sectional view taken along LINE 5-5 in FIG. 3.
Figure 6:
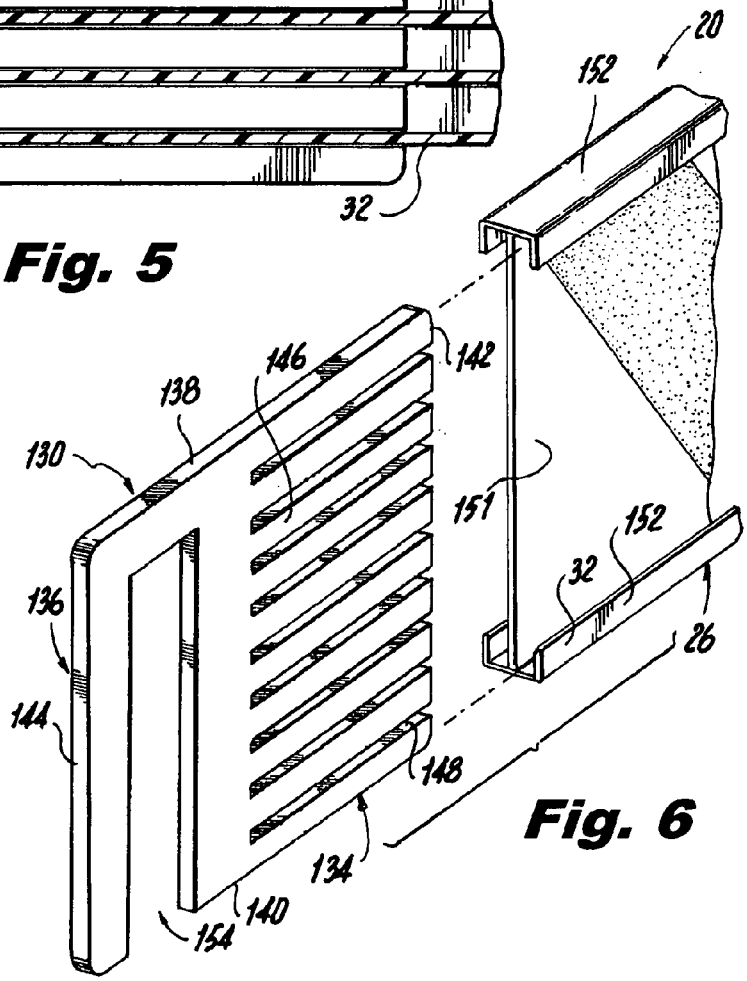
FIG. 6 is an enlarged exploded perspective view of the first embodiment of the bracket of the present invention connecting to another kind of crossbar of a conventional PVC sawhorse.

The specific configuration of a first embodiment of the bracket 130 can best be seen in FIGS. 4, 5, and 6, which are, respectively, an enlarged exploded perspective view of the area generally enclosed by the dotted curve identified by ARROW 4 in FIG. 3, an enlarged diagrammatic cross sectional view taken along LINE 5-5 in FIG. 3, and an enlarged exploded perspective view of the first embodiment of the bracket of the present invention connecting to another kind of crossbar of a conventional PVC sawhorse, and as such, will be discussed with reference thereto.

The first portion 134 and the second portion 136 are affixed to each other, and together are generally rectangular shaped with a top edge 138, a bottom edge 140, an inner edge 142, and an outer edge 144.

(1) First Portion 134.

The first portion 134 has a plurality of fingers 146 separated by spaces 148. The plurality of fingers 146 of the first portion 134 extend parallel to the top edge 138 of the first portion 134 and the second portion 136 and the bottom edge 140 of the first portion 134 and the second portion 136, and the spaces 148 of the first portion 134 open into the inner edge 142 of the first portion 134 and the second portion 136.

The plurality of fingers 146 of the first portion 134 are for extending into the end 32 of the crossbar 26 of the conventional PVC sawhorse 20.

As shown in FIGS. 4 and 5, when the crossbar 26 of the conventional PVC sawhorse 20 contains axial cells 150, the plurality of fingers 146 of the first portion 134 are replaceably received in the axial cells 150 of the crossbar 26 of the conventional PVC sawhorse 20, respectively.

As shown in FIG. 6, when the crossbar 26 of the conventional PVC sawhorse 20 contains a web 150 and a pair of channeled flanges 152, the plurality of fingers 146 of the first portion 134 are replaceably received as a unit to one side of the web 150 of the crossbar 26 of the conventional PVC sawhorse 20, and are maintained thereat by the pair of channeled flanges 152 of the crossbar 26 of the conventional PVC sawhorse 20.

(2) Second Portion 136.

The second portion 136 has a throughslot 154. The throughslot 154 of the second portion 136 is parallel to and inward of the outer edge 144, and extends from inward of the the top edge 138 of the first portion 134 and the second portion 136 to and opening into the bottom edge 140 of the first portion 134 and the second portion 136 for receiving the crossbar 32 of the another conventional PVC sawhorse 20 by sliding down over the crossbar 32 of the another conventional PVC sawhorse 20.

D. Specific Configuration of a Second Embodiment of the Bracket 230.

Figure 7:
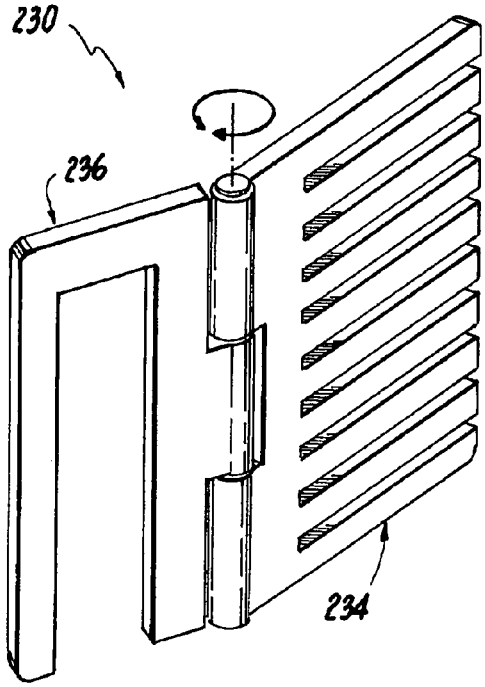
FIG. 7 is a diagrammatic perspective view of a second embodiment of the bracket of the present invention.
Figure 8:
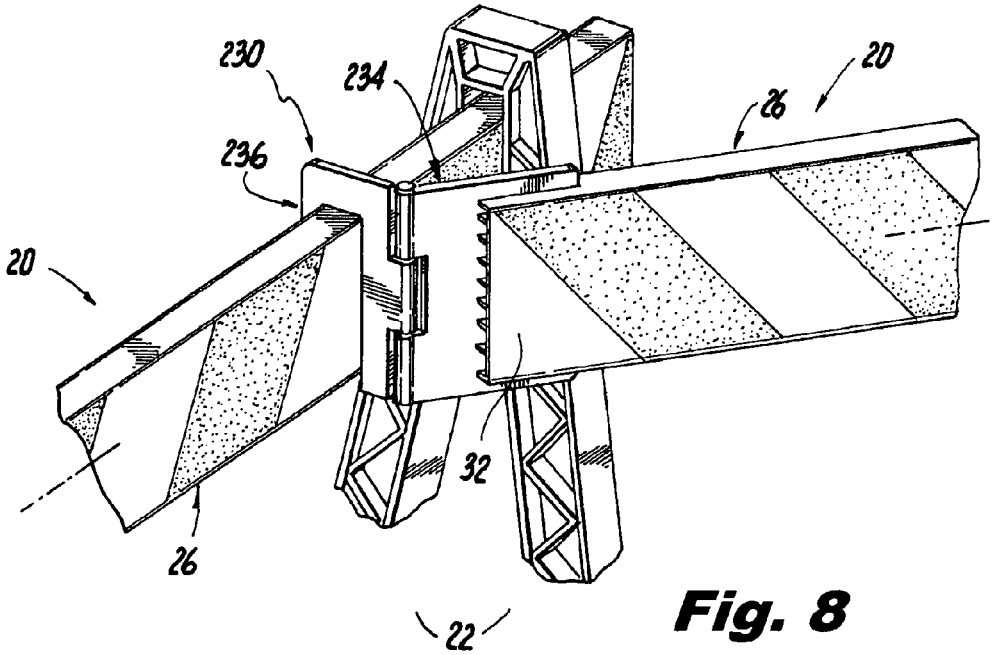
FIG. 8 is a diagrammatic perspective view of the second embodiment of the bracket of the present invention replaceably connecting an end of a crossbar of a conventional PVC sawhorse to a crossbar of another conventional PVC sawhorse to thereby replaceably connect the conventional PVC sawhorse at a desired angle to the another conventional PVC sawhorse to form a barrier.

The specific configuration of a second embodiment of the bracket 230 can best be seen in FIGS. 7 and 8, which are, respectively, a diagrammatic perspective view of a second embodiment of the bracket of the present invention, and a diagrammatic perspective view of the second embodiment of the bracket of the present invention replaceably connecting an end of a crossbar of a conventional PVC sawhorse to a crossbar of another conventional PVC sawhorse to thereby replaceably connect the conventional PVC sawhorse at a desired angle to the another conventional PVC sawhorse to form a barrier, and as such, will be discussed with reference thereto.

The bracket 230 is similar to the bracket 130, except that the first portion 234 is rotatably attached to the second portion 236 for replaceably connecting the end 32 of the crossbar 26 of the conventional PVC sawhorse 20 to the crossbar 26 of the another conventional PVC sawhorse 20 to thereby replaceably connect the conventional PVC sawhorse 20 at a desired angle to the another conventional PVC sawhorse 20 to form the barrier 22.

E. Specific Configuration of a Third Embodiment of the Bracket 330.

The specific configuration of a third embodiment of the bracket 330 can best be seen in FIG. 9, which is an exploded diagrammatic perspective view of a third embodiment of the bracket of the present invention connecting the one kind of crossbar of the conventional PVC sawhorse coaxially to the one kind of crossbar of the another conventional PVC sawhorse, and as such, will be discussed with reference thereto.

The bracket 330 is similar to the bracket 130, except that the second portion 336 is a mirror image of the first portion 334, and is for connecting the end 32 of the crossbar 26 of the conventional PVC sawhorse 20 coaxially to the end 32 of the crossbar 26 of the another conventional PVC sawhorse 20 to form the barrier 22.

F. Specific Configuration of a Fourth Embodiment of the Bracket 430.

The specific configuration of a fourth embodiment of the bracket 430 can best be seen in FIG. 10, which is an enlarged exploded perspective view of a fourth embodiment of the bracket of the present invention connecting to the one kind of crossbar of the conventional PVC sawhorse, and as such, will be discussed with reference thereto.

The bracket 430 is similar to the bracket 130, except that the first portion 434 has a central portion 456 that is absent the plurality of fingers 446 so as to provide only upper and lower fingers 457 for insertion into only upper and lower portions 458 of the axial cells 450 of the crossbar 26 of the conventional PVC sawhorse 20.

G. Impressions.

It will be understood that each of the elements described above or two or more together may also find a useful application in other types of constructions differing from the types described above.

While the embodiments of the present invention have been illustrated and described as embodied in a bracket for replaceably connecting an end of a crossbar of a conventional PVC sawhorse to a crossbar of another conventional PVC sawhorse to thereby replaceably connect the conventional PVC sawhorse to the another conventional PVC sawhorse to form a barrier, however, they are not limited to the details shown, since it will be understood that various omissions, modifications, substitutions, and changes in the forms and details of the embodiments of the present invention illustrated and their operation can be made by those skilled in the art without departing in any way from the spirit of the embodiments of the present invention.

Without further analysis the foregoing will so fully reveal the gist of the embodiments of the present invention that others can by applying current knowledge readily adapt them for various applications without omitting features that from the standpoint of prior art fairly constitute characteristics of the generic or specific aspects of the embodiments of the present invention.

The invention claimed is:

1. A bracket for replaceably connecting an end of a crossbar of a conventional PVC sawhorse to a crossbar of another conventional PVC sawhorse to thereby replaceably connect the conventional PVC sawhorse to the another conventional PVC sawhorse to form a barrier, comprising:

a) a first portion; and b) a second portion;

wherein said first portion and said second portion are normally coplanar;

wherein said first portion is for being replaceably received by the end of the crossbar of the conventional PVC sawhorse;

wherein said first portion has a rotary edge;

wherein said rotary edge of said first portion is vertically oriented so as to form a vertically oriented rotary edge;

wherein said second portion has a rotary edge;

wherein said rotary edge of said second portion is vertically oriented so as to form a vertically oriented rotary edge; and wherein said vertically oriented rotary edge of said first portion is rotatably attached to said vertically oriented rotary edge of said second portion for replaceable connecting the end of the crossbar of the conventional PVC sawhorse to the crossbar of the another conventional PVC sawhorse to thereby replaceably connect the conventional PVC sawhorse at a desired angle to the another conventional PVC sawhorse to form the barrier, wherein said first portion and said second portion together are generally rectangular shaped; and wherein said first portion and said second portion together have: a) a top edge; b) a bottom edge; c) an inner edge; and d) an outer edge, wherein said first portion has a plurality of fingers; and wherein said plurality of fingers of said first portion are separated by spaces.

2. The bracket of claim 1, wherein said plurality of fingers of said first portion extend parallel to said top edge of said first portion and said second portion and said bottom edge of said first portion and said second portion; and wherein said spaces of said first portion open into said inner edge of said first portion and said second portion.

3. The bracket of claim 1, further comprising a conventional PVC sawhorse;

wherein said conventional PVC sawhorse has a crossbar;

wherein said crossbar of said conventional PVC sawhorse has an end; and wherein said plurality of fingers of said first portion extend into said end of said crossbar of said conventional PVC sawhorse.

4. The bracket of claim 3, wherein said crossbar of said conventional PVC sawhorse contains axial cells; and wherein said plurality of fingers of said first portion are replaceably received in said axial cells of said crossbar of said conventional PVC sawhorse, respectively.

5. The bracket of claim 3, wherein said crossbar of said conventional PVC sawhorse contains a web and a pair of channeled flanges, said plurality of fingers of said first portion are received as a unit to one side of the web of the crossbar of the conventional PVC sawhorse, and are maintained thereat by the pair of channeled flanges of the crossbar of the conventional PVC sawhorse.

6. The bracket of claim 1, wherein said second portion has a throughslot;

wherein said throughslot of said second portion is parallel to said outer edge of said first portion and said second portion;

wherein said throughslot of said second portion is inward of said outer edge of said first portion and said second portion;

wherein said throughslot of said second portion extends from inward of said top edge of said first portion and said second portion to said bottom edge of said first portion and said second portion;

wherein said throughslot of said second portion opens into said bottom edge of said first portion and said second portion; and wherein said throughslot of said second portion is for receiving the crossbar of the another conventional PVC sawhorse by sliding down over the crossbar of the another conventional PVC sawhorse.

* * * * *